United States Patent [19]

Vetter

[11] Patent Number: 4,897,964

[45] Date of Patent: Feb. 6, 1990

[54] GRINDING MACHINE WITH DRESSING APPARATUS AND METHOD OF DRESSING GRINDING WHEELS THEREIN

[75] Inventor: Ulrich Vetter, Stuttgart, Fed. Rep. of Germany

[73] Assignee: Schaudt Maschinenbau GmbH, Stuttgart, Fed. Rep. of Germany

[21] Appl. No.: 275,122

[22] Filed: Nov. 22, 1988

[30] Foreign Application Priority Data

Nov. 27, 1987 [DE] Fed. Rep. of Germany ..... 3740199

[51] Int. Cl.[4] ..... B24B 7/00

[52] U.S. Cl. ..... 51/5 D; 125/11 CD; 125/11 R; 51/165.71

[58] Field of Search ..... 125/11 CD, 11 R, 11 AT, 125/11 A; 51/5 D, 165.71, 165.77

[56] References Cited

U.S. PATENT DOCUMENTS

| | | | |
|---|---|---|---|
| 3,498,161 | 3/1970 | Kump | 82/12 |
| 3,897,659 | 8/1975 | Henry | 51/165.75 X |
| 4,219,972 | 9/1980 | Ota et al. | 125/11 CD |
| 4,557,078 | 12/1985 | Brill | 51/325 |
| 4,559,919 | 12/1985 | Kushigian | 51/165.71 X |
| 4,571,892 | 2/1986 | Brill | 51/325 |
| 4,603,677 | 8/1986 | Gile et al. | 125/11 R |
| 4,696,130 | 9/1987 | Belthle | 51/293 |
| 4,765,095 | 8/1988 | Wiener | 51/5 D X |

FOREIGN PATENT DOCUMENTS

| | | | |
|---|---|---|---|
| 2510393 | 9/1976 | Fed. Rep. of Germany | 125/11 CD |
| 3437682 | 5/1985 | Fed. Rep. of Germany | 125/11 R |
| 0073273 | 4/1984 | Japan | 51/165.71 |
| 0167765 | 8/1985 | Japan | 125/11 R |

*Primary Examiner*—Frederick R. Schmidt
*Assistant Examiner*—Shirish Desai
*Attorney, Agent, or Firm*—Peter K. Kontler

[57] ABSTRACT

A grinding wheel with a working surface having a complex profile is subjected to a path-controlled dressing operation by an apparatus which moves in the direction of the Z-axis of the machine while the grinding wheel moves in the direction of the X-axis. When necessary in view of configuration of the momentarily dressed portion of the working surface, the grinding wheel is turned about the B-axis of the machine, and such axis is remote from the point of contact between the dressing tool and the working surface and is normal to the Z- and X-axes. The controls of the grinding machine cause the dressing tool and the grinding wheel to perform additional movements in the direction of the Z- and X-axes so as to compensate for those deviations from the preselected movement which are due to turning of the grinding wheel about the B-axis. The controls include an interpolator which modifies signals from the numerical controls of the machine and transmits modified signals to regulators for motors which initiate movements of the dressing tool in the direction of the Z-axis, movements of the grinding wheel in the direction of the X-axis, and (when necessary) turning of the grinding wheel about the B-axis.

6 Claims, 2 Drawing Sheets

GRINDING MACHINE WITH DRESSING APPARATUS AND METHOD OF DRESSING GRINDING WHEELS THEREIN

BACKGROUND OF THE INVENTION

The invention relates to improvements in path-controlled dressing of grinding wheels in grinding machines. More particularly, the invention relates to improvements in grinding machines wherein the dressing of working surface of a grinding wheel involves a movement of the dressing tool in a first direction and a movement of the grinding wheel in a different second direction. Still more particularly, the invention relates to improvements in methods of and in assemblies for dressing grinding wheels wherein the dressing operation further involves a pivotal or angular movement resulting in a change of orientation of the dressing tool and grinding wheel relative to each other.

Dressing operations involving the treatment of working surfaces of grinding wheels wherein the working surface has a relatively simple profile are carried out by moving the dressing tool in a first direction and by moving the grinding wheel in a second direction which, at least in many instances, is normal to the first direction. The point of contact between the dressing tool and the grinding wheel follows the desired contour or profile of the working surface of the grinding wheel. If the working surface of the grinding wheel has a rather complex profile, the dressing tool is caused to turn about a predetermined axis in order to ensure that the plane of the dressing tool will be maintained at an optimum angle to the adjacent portion of the working surface. Reference may be had to U.S. Pat. No. 4,603,677 granted Aug. 5, 1986 to Gile et al. for "Orthogonal dressing of grinding wheels." The disclosure of this patent is incorporated herein by reference. Thus, it is necessary to install the dressing tool in such a way that it can perform a linear movement as well as an angular movement while it treats a complex working surface. Such dressing apparatus contribute to complexity, space requirements and overall cost of the grinding machine.

OBJECTS OF THE INVENTION

An object of the invention is to provide a novel and improved method of dressing simple and/or complex working surfaces on rotary grinding wheels in such a way that the orientation of the dressing apparatus need not be changed while the dressing tool contacts and treats the working surface.

Another object of the invention is to provide a method which renders it possible to move all parts which cooperate in the course of a dressing operation in the directions of and/or about standard axes of a grinding machine.

A further object of the invention is to provide a method which is ideally suited for the dressing of complex or extremely complex working surfaces, for example of working surfaces with rather pronounced transitions between neighboring portions of the profile.

An additional object of the invention is to provide a grinding machine which is equipped with a dressing apparatus and can be utilized for the practice of the above outlined method.

Still another object of the invention is to provide a novel and improved workhead for use in the above outlined grinding machine.

A further object of the invention is to provide novel and improved controls for the above outlined grinding machine.

A further object of the invention is to provide a grinding machine which can employ grinding wheels with working surfaces having complex contours or profiles and wherein such working surfaces can be dressed by a very simple, compact and inexpensive dressing apparatus which is called upon to perform movements in the direction of a single axis.

SUMMARY OF THE INVENTION

One feature of the invention resides in the provision of a method of path-controlled dressing of the working surface of a rotating grinding tool with a dressing tool in a grinding machine. The method comprises the steps of contacting the working surface of the grinding tool by the dressing tool, moving the dressing tool and the grinding tool relative to each other (in the direction of at least two axes which are inclined with respect to one another) to an extent which is dependent upon the profile or contour of the working surface while the dressing tool continues to contact the working surface, and changing the inclination of the grinding tool and dressing tool relative to each other as a function of the profile of the working surface. In accordance with a feature of the method, the inclination changing step includes changing the orientation of the grinding tool relative to the dressing tool.

In accordance with a presently preferred embodiment, the orientation changing step includes moving the grinding tool in a direction to maintain the profile of the working surface at least close to a position at right angles to the plane of the dressing tool. Such orientation changing step preferably includes turning the grinding tool about a further axis which is remote from the point of contact between the working surface and the dressing tool in the course of the dressing operation. The further axis is normal to the two axes.

The method preferably further comprises the step of additionally moving at least one of the tools linearly in the direction of one of the two axes to an extent which is a function of the orientation changing step.

The moving and orientation changing steps preferably take place by moving the respective tools in the direction of at least two of the B-, X- and Z-axes of the grinding machine.

Another feature of the invention resides in the provision of a grinding machine which comprises a wheelhead having at least one rotary grinding spindle and at least one grinding tool provided on the spindle and having a working surface, a dressing apparatus including a rotary dressing tool, drive means for changing the positions of the spindle and dressing tool relative to each other in the direction of two axes which are inclined relative to each other, means for changing the orientation of the tools relative to each other while the dressing tool contacts and dresses the working surface including means for changing the orientation of the spindle, and means for controlling the moving means and the orientation changing means as a function of the profile or contour of the working surface of the grinding tool.

The means for changing the orientation of the spindle can include means for turning the spindle about an axis which is remote from the point of contact between the working surface and the dressing tool in the course of a dressing operation. Such turning means includes means for turning the spindle (and hence the grinding tool) about a further axis which is normal to the two axes.

The controlling means comprises means for compensating for deviations of movements of the tools in the direction of the two axes during dressing of the working surface as a result of changes of orientation of the spindle.

The grinding machine preferably further comprises a carriage (e.g., in the form of a table) which supports the dressing apparatus and is reciprocable in the direction of one of the two axes, and a slide or a like part which supports the spindle and is reciprocable in the direction of the other of the two axes. The one axis can constitute the Z-axis and the other axis can constitute the X-axis of the grinding machine.

The controlling means can include a machine control unit, interpolator means receiving signals from the control unit, and regulator means receiving signals from the interpolator means and serving to control the operation of motors which form part of the moving and orientation changing means. The control unit includes means for transmitting to the interpolator means signals denoting the desired profile or contour of the working surface of a grinding tool which is being dressed, and the interpolator means comprises means for modifying signals from the control unit as a function of orientation of the spindle and for transmitting modified signals to the regulator means for the drive means and the orientation changing means.

The novel features which are considered as characteristic of the invention are set forth in particular in the appended claims. The improved grinding machine itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
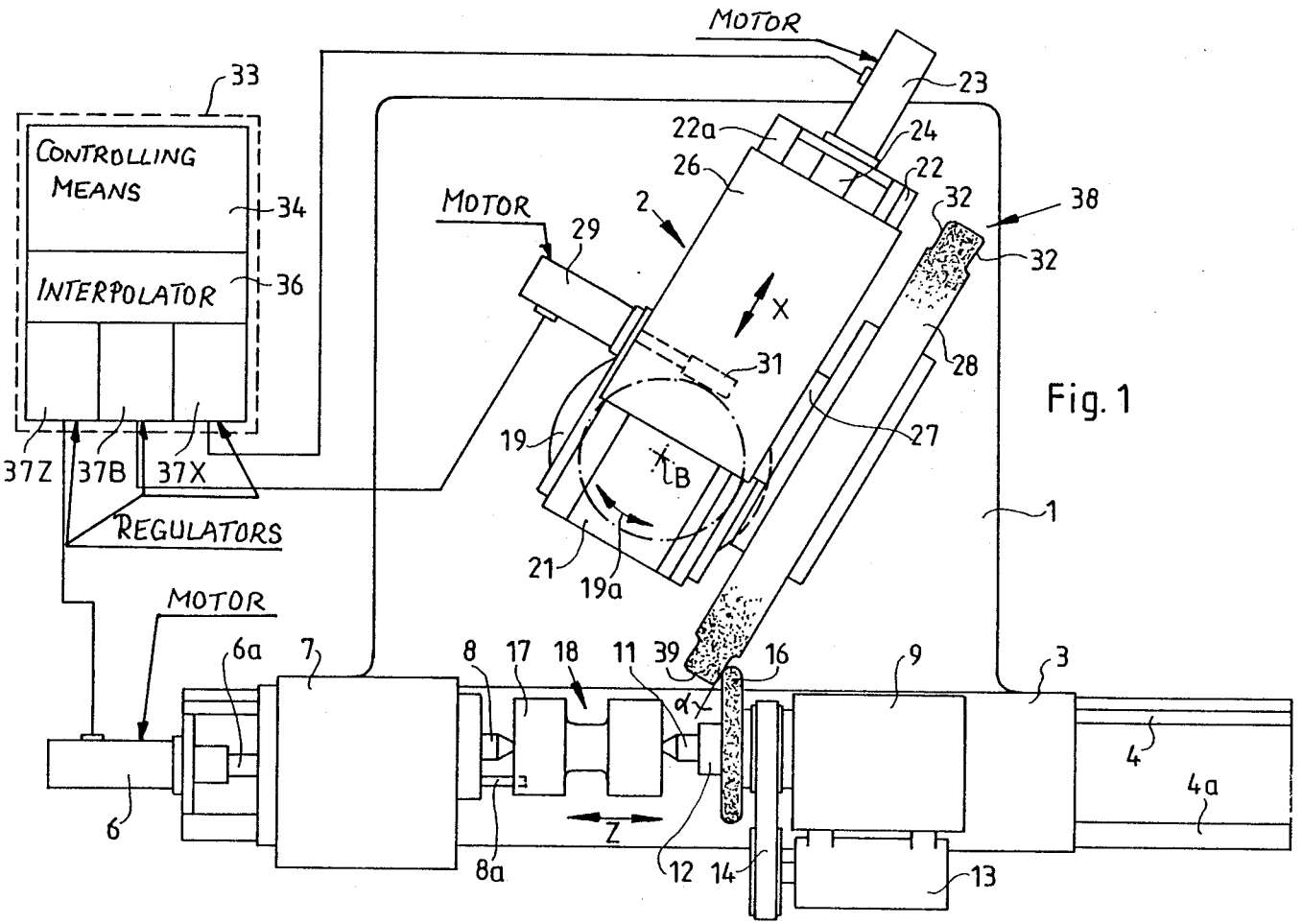
FIG. 1 is a schematic plan view of a grinding machine which embodies one form of the present invention.

FIG. 1 shows a plain (circular or cylindrical) grinding machine which comprises a base or bed 1 having parallel guides 4, 4*a* for a reciprocable table or carriage 3. The base 1 further supports a wheelhead 2 adjacent one side of the carriage 3. The guides 4, 4*a* extend in the direction of the Z-axis of the grinding machine, and the drive means for moving the carriage 3 along a straight (linear) path which is defined by these guides includes a reversible electric or other suitable motor 6 which is operatively connected with the carriage 3 by a transmission including a rotary spindle 6*a*.

The carriage 3 supports a headstock 7 having a driven center 8 and a torque-transmitting element 8*a*, and a tailstock 9 with a center 11 mounted on a tailstock sleeve 12. The latter supports a toroidal dressing tool 16 (e.g., a doughnut-shaped diamond roll) forming part of an apparatus for dressing the working surface 38 of a rotary grinding tool 28 (hereinafter called grinding wheel). The dressing apparatus further comprises a motor 13 which is affixed to the tailstock 9 and can drive the dressing tool 16 through the medium of a belt transmission 14. The reference character 17 denotes a workpiece which is held between the centers 8, 11 and has a circumferentially extending groove 18 bounded by a concave surface. The grinding wheel 28 serves to remove material from the surface around the groove 18.

The wheelhead 2 includes a support 21 which is mounted on a turntable 19 and is provided with parallel guides 22, 22*a* for a slide 26 mounting a rotary spindle 27 for the grinding wheel 28. The drive means for moving the slide 26 along the guides 22, 22*a* includes a motor 23 which is mounted on the guides 22, 22*a* and/or on the support 21 and is operatively connected with the slide 26 by a rotary spindle 24 so that the slide 26, the tool spindle 27 and the grinding wheel 28 can be moved in directions of the X-axis of the machine, namely at an angle to the Z-axis. The support 21 can be caused to turn relative to the turntable 19 about a vertical axis B (which is normal to the X- and Z-axes) by a further motor 29 which can turn the support through the medium of a worm gearing 31. The directions in which the support 21 can turn with the slide 26, spindle 27 and grinding wheel 28 about the axis B are indicated by a double-headed arrow 19*a*.

The profile or contour of the working surface 38 of the grinding wheel 28 is dependent upon the desired final configuration of the surface surrounding the groove 18 of the workpiece 17. The illustrated working surface 38 has two undercut lateral flanks 32 in order to reduce the likelihood of excessive rubbing contact between the working surface 38 and the workpiece 17 when the grinding wheel 28 is in the process of removing material from the workpiece. The flanks 32 extend radially inwardly from a substantially cylindrical peripheral surface 39 with a rather abrupt but smooth transition between such peripheral surface and both flanks.

The grinding machine further comprises controlling means 33 including a control unit 34 of conventional design (this control unit serves to control the movements of the carriage 3 and wheelhead 2 relative to each other when the grinding machine is in actual use, i.e., when the grinding wheel 28 removes material from the workpiece 17), a 3-axis interpolator 36 which receives signals from the control unit 34, and three regulators 37Z, 37B and 37X. These regulators receive modified signals from the interpolator 36 and transmit signals to the motors 6, 29 and 23, respectively (note the non-referenced conductor means between the regulators and the associated motors).

Figure 2:
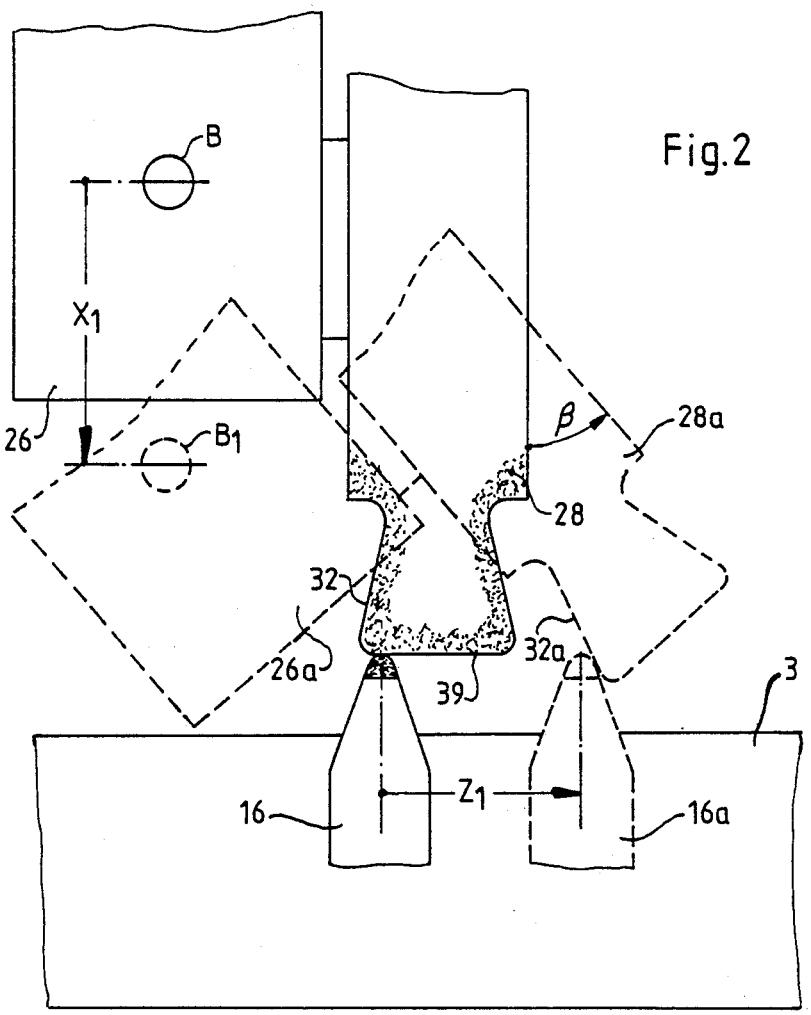
FIG. 2 is an enlarged view of a detail in the grinding machine of FIG. 1, the dressing tool and the grinding tool being shown in two different positions including broken-line positions which they assume as a result of a change of orientation of the grinding tool and linear movements of the dressing tool and grinding tool which are necessitated by such change of orientation.

FIG. 1 shows the apparatus including the dressing tool 16, the motor 13 and the transmission 14 in the process of dressing the working surface 38 of the grinding wheel 28. The dressing operation is particularly satisfactory if the dressing tool 16 extends substantially at right angles to the tangent at that point of the working surface 38 which is contacted by the dressing tool. In accordance with a feature of the invention, such mutual positioning of the grinding wheel 28 and dressing tool 16 is achieved by changing the orientation of the grinding wheel 28 relative to the dressing tool 16 in the course of the dressing operation, i.e., while the dressing tool contacts the working surface 38. To this end, the regulator 37B causes the motor 29 and the worm gearing 31 to turn the support 21 (and hence the grinding wheel 28) about the axis B, i.e., about an axis which is remote from the point of contact between the dressing tool 16 and the working surface 38 while the tool 16 is in the process of dressing the grinding wheel 28. The extent of angular or turning movement of the rotating grinding wheel 28 relative to the rotating dressing tool 16 is such that the flank 32 which is adjacent the dressing tool and the plane of the dressing tool make an optimum clearance or relief angle alpha. If the construction of the grinding machine and the geometries of the dressing tool 16 and of the working surface 38 permit it, the clearance angle alpha will approach a right angle, i.e., the plane of the dressing tool will extend substantially at right angles to the adjacent portion of the working surface 38. The regulation (by 37B) which is necessary to ensure such orientation of the working surface 38 and dressing tool 16 relative to each other is initiated by the control unit 34 of the grinding machine. This control unit stores information pertaining to the desired profile of the working surface 38 and to the magnitude of the corresponding angle beta (FIG. 2) indicating the extent of change of orientation of the grinding wheel 28 as a result of turning the support 21 and grinding wheel 28 about the axis B. The control unit 34 transmits (by way of the interpolator 36) to the regulators 37Z and 37X for the motors 6 and 23 data denoting the positions of the carriage 3 and support 21 in the directions of the Z-and X-axes in dependency on the desired profile or contour of the working surface 38 of the grinding wheel 28. For example, the substantially cylindrical peripheral surface 39 of the grinding wheel 28 can be dressed in response to signals denoting the position of the slide 26 in the direction of the X-axis and a sequence of positions of the dressing tool 16 in the direction of the Z-axis. This is indicated in FIG. 2 by solid lines. When the dressing tool 16 has completed the treatment of the peripheral surface 39 and is to dress the transition zone between the surface 39 and one of the flanks 32, the motor 29 is caused to turn the support 21 and the grinding wheel 28 about the axis B so as to move the momentarily treated portion of the working surface 38 close to a position at right angles to the plane of the dressing tool. FIG. 2 indicates by broken lines that position (28*a*) of the grinding wheel 28 when the motor 29 has completed a turning of the support 21 through the angle beta. The flank 32 which is about to be treated then assumes the broken-line position 32*a*. This ensures that the angle alpha between the flank 32 (in the position 32*a*) and the plane of the dressing tool 16 assumes an optimum value.

It is not always possible to ensure that the plane of the dressing tool 16 will assume a position exactly at right angles to the adjacent portion of the working surface 38. This is due to the particular design of a grinding machine and/or to other parameters, such as the profile or contour of the working surface 38. However, it is desirable to ensure that the angle alpha be relatively large and that it at least approximate the optimum value. This contributes to quality of the dressing operation.

Since the axis B does not extend through the point of contact between the dressing tool 16 and the working surface 38 of the grinding wheel 28, it is necessary to move the carriage 3 in the direction of the axis Z and/or to move the slide 26 in the direction of the axis X whenever the motor 29 is started to turn the support 21. FIG. 2 shows (at $X_1$) the extent of movement of the slide 26 in the direction of the axis X, and (at $Z_1$) the extent of movement of the carriage 3 and dressing tool 16 in the direction of the axis Z when the grinding wheel 28 is caused to change its orientation through the angle beta. This results in a movement of the slide 26 to the broken-line position 26*a* and in a movement of the dressing tool 16 to the broken-line position 16*a*.

Signals which initiate movements of the slide 26 to the position 26*a* and of the dressing tool 16 to the position 16*a* are transmitted by the interpolator 36 which is connected with the control unit 34 as well as with the regulators 37Z and 37X for the motors 6 and 23, respectively. The interpolator 36 is designed to assign, on the basis of programmed information which is stored in a memory of the control unit 34 and denotes data pertaining to the positions of the slide 26 and carriage 3 in the directions of the X- and Z-axes, correction data corresponding to the angle beta, and such correction data are superimposed upon data furnished by the memory of the control unit 34. Thus, the interpolator 36 modifies the information from the control unit 34 as a function of the extent of change of orientation of the grinding wheel 28 relative to the dressing tool 16, i.e., as a function of the magnitude of angle beta which denotes the extent to which the support 21 is turned by the motor 29 in response to signals from the regulator 37B.

Once the dressing tool 16 has reached the flank 32 (in the position 32*a*, as seen in FIG. 2), the motor 29 need no longer change the orientation of the grinding wheel 28. The dressing operation is then controlled as a result of programmed movements of the dressing tool 16 in the direction of the axis Z and of the grinding wheel 28 in the direction of the axis X. Such dressing operation proceeds until the point of contact between the dressing tool 16 and the grinding wheel 28 again reaches a portion of the working surface 38 which cannot be properly treated without changing the orientation of the grinding wheel, i.e., without turning the slide 26 about the axis B.

It will be seen that the dressing operation involves movements of dressing tool 16 in the direction of the Z-axis as well as movements of the grinding wheel 28 about the axis B and/or in the direction of the axis X. Thus, all of these movements take place in the direction of or about the three standard axes of a grinding machine. This not only simplifies the controls of the machine but also ensures a highly satisfactory dressing operation. There is no need to provide means for turning the dressing apparatus about a discrete axis. Such turning means would contribute to complexity and higher cost of the dressing apparatus and of the entire grinding machine.

The control unit 34 is or can be a standard control unit of the type used in numerically controlled grinding machines. This control unit cooperates with the interpolator 36 to ensure the transmission of appropriate signals to the regulators 37B, 37X, 37Z and hence to the motors 29, 6 and 23 which initiate movements of the dressing tool 16 and grinding wheel 28 in the course of a dressing operation.

It goes without saying that the profile or contour of the working surface 38 which is shown in FIGS. 1 and 2 is but one of numerous profiles which can be dressed in accordance with the method of the present invention.

Prior methods of dressing grinding wheels are disclosed in numerous pending U.S. and foreign patent applications and in numerous U.S. and foreign patents of the assignee of the present application. Reference may be had, for example, to U.S. Pat. No. 4,557,078 granted Dec. 10, 1985 to Jürgen Brill for "Method of dressing and finishing grinding wheels", to U.S. Pat. No. 4,571,892 granted Feb. 25, 1986 to Jürgen Brill for "Method of dressing grinding wheels in grinding machines", and to U.S. Pat. No. 4,696,130 granted Sept. 29, 1987 to Heinz Belthle for "Method of profiling and dressing grinding wheels".

A further method of dressing grinding wheels is disclosed in U.S. patent application Ser. No. 227,238 filed Aug. 2, 1988 by Heinrich Mushardt et al. for "Method of and apparatus for dressing grinding wheels".

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A grinding machine comprising a wheelhead having at least one rotary grinding spindle and at least one grinding tool provided on said spindle and having a working surface; a dressing apparatus including a dressing tool; drive means for changing the positions of said spindle and said apparatus relative to each other in the direction of two axes which are inclined relative to each other; means for changing the orientation of said tools relative to each other while said dressing tool contacts and dresses said working surface, including means for changing the orientation of said spindle, said orientation changing means comprising means for turning said spindle about an axis which is remote from the point of contact between the working surface and said dressing tool; and means for controlling said drive means and said orientation changing means as a function of the profile of the working surface of said grinding tool, including means for compensating for deviations of movement of said tools in the directions of said two axes during dressing of said working surface as a result of changes of orientation of said spindle.

2. The machine of claim 1, wherein said remote axis is normal to said two axes.

3. The machine of claim 1, further comprising a carriage supporting said apparatus and being reciprocable in the direction of one of said axes, said spindle being reciprocable in the direction of the other of said axes.

4. The machine of claim 3, wherein said one axis is the Z-axis and said other axis is the X-axis of the machine.

5. The machine of claim 1, wherein said means for controlling includes a machine control unit, interpolator means, and regulator means for said drive means and said orientation changing means, said regulator means being connected with said interpolator means.

6. The machine of claim 5, wherein said control unit includes means for transmitting to said interpolator means signals denoting the desired profile of the working surface, said interpolator means comprising means for modifying said signals as a function of the orientation of said spindle and for transmitting modified signals to said regulator means.

* * * * *